US008678512B2

(12) United States Patent
Wang

(10) Patent No.: US 8,678,512 B2
(45) Date of Patent: Mar. 25, 2014

(54) HIGH CHAIR

(76) Inventor: Kun Wang, Taichung (TW)

( * ) Notice: Subject to any disclaimer, the term of this patent is extended or adjusted under 35 U.S.C. 154(b) by 90 days.

(21) Appl. No.: 13/450,174

(22) Filed: Apr. 18, 2012

(65) Prior Publication Data

US 2013/0278040 A1 Oct. 24, 2013

(30) Foreign Application Priority Data

Jun. 17, 2011 (CN) ..... 2011 1 0163862

(51) Int. Cl.
*A47D 15/00* (2006.01)
*A47C 31/00* (2006.01)

(52) U.S. Cl.
USPC ..... 297/484; 297/483

(58) Field of Classification Search
USPC ..... 297/484, 483
See application file for complete search history.

(56) References Cited

U.S. PATENT DOCUMENTS

| | | | | |
|---|---|---|---|---|
| 6,695,412 | B2 * | 2/2004 | Barger et al. | 297/484 |
| 7,458,644 | B2 * | 12/2008 | Beermann et al. | 297/483 |
| 7,469,965 | B2 * | 12/2008 | Glover et al. | 297/484 |
| 7,547,065 | B2 * | 6/2009 | Barger | 297/483 |
| 7,703,806 | B2 * | 4/2010 | Bell et al. | 297/483 |

* cited by examiner

*Primary Examiner* — Anthony D Barfield
(74) *Attorney, Agent, or Firm* — Hershkovitz & Associates, PLLC; Abe Hershkovitz

(57) ABSTRACT

A high chair has a chair device and a fastener device. The fastener device is connected with the chair device and has a main body, a button and a button elastic member. The main body has a buckle recess formed in the main body and having an open side. The button is capable of retracting or protruding relative to a bottom of the buckle recess. The button elastic member is mounted in the main body and presses against the button. To push and pull the button allows a belt buckle to be easily taken out from and inserted into the buckle recess.

2 Claims, 8 Drawing Sheets

HIGH CHAIR

BACKGROUND OF THE INVENTION

1. Field of the Invention

The present invention relates to a high chair, and more particularly to a high chair having a fastener device to allow a belt buckle to be easily taken out and inserted.

2. Description of Related Art

With reference to FIGS. 8 and 9, a conventional high chair has a main chair 70, multiple fastener devices 80 and a belt unit 90. The main chair 70 has an inner surface. The fastener devices 80 are connected with the inner surface of the main chair 70.

Each fastener device 80 has a main body 81, a flexible strip 82 and a button 83. The main body 81 is securely mounted on the main chair 70 and has an outer surface and a buckle recess formed in the outer surface of the main body 81. The flexible strip 82 is integrally mounted on the main body 81 and has a distal end. The button 83 is integrally mounted on the distal end of the flexible strip 82.

The belt unit 90 has a belt buckle 91 detachably connected with the buckle recess of the main body 81.

When the belt buckle 91 is about to escape from the buckle recess of the main body 81, the button 83 has to be pushed downwardly to bend the flexible strip 82. Accordingly, the belt buckle 91 is not pressed by the button 83 and can escape from the buckle recess toward a right side of FIG. 8.

However, the flexible strip 82 is integrally connected with the main body 81. When the button 83 is pushed, a fulcrum P is generated at a position where the flexible strip 82 is integrally connected with the main body 81. Accordingly, the bent flexible strip 82 generates a force that makes the button 83 tightly press against a bottom of the belt buckle 91 and prevents the belt buckle 91 from escaping. Consequently, the belt buckle 91 is hard to be taken out. Similarly, the belt buckle 91 is also hard to be inserted into the buckle recess of the main body 81.

To overcome the shortcomings, the present invention tends to provide a high chair to mitigate the aforementioned problems.

SUMMARY OF THE INVENTION

The main objective of the invention is to provide a high chair having a fastener device to allow a belt buckle to be easily taken out and inserted.

A high chair has a chair device and a fastener device. The fastener device is connected with the chair device and has a main body, a button and a button elastic member. The main body has a buckle recess formed in the main body and having an open side. The button is capable of retracting or protruding relative to a bottom of the buckle recess. The button elastic member is mounted in the main body and presses against the button. Because to push and pull the button is easy, a belt buckle is easily taken out from and inserted into the buckle recess.

Other objects, advantages and novel features of the invention will become more apparent from the following detailed description when taken in conjunction with the accompanying drawings.

DETAILED DESCRIPTION OF PREFERRED EMBODIMENT

Figure 1:
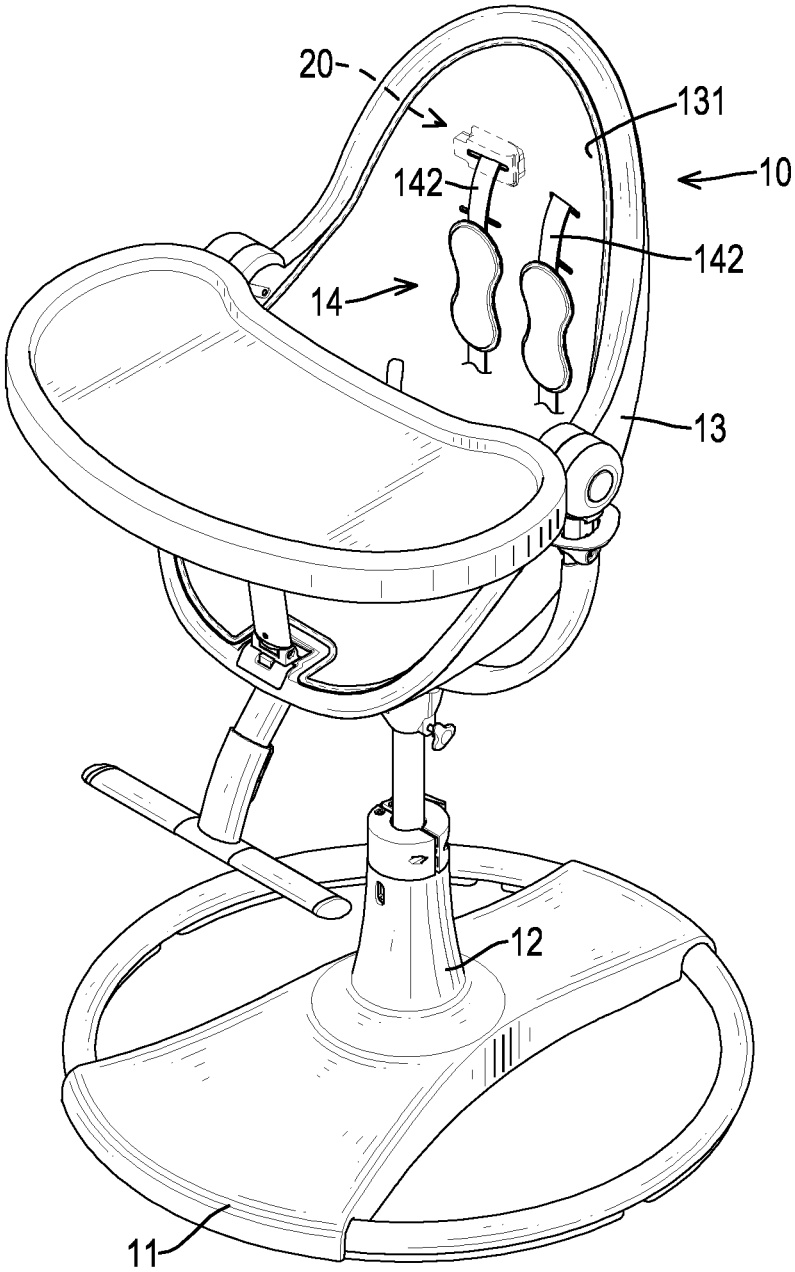
FIG. 1 is a perspective view of a high chair in accordance with the present invention.
Figure 2:
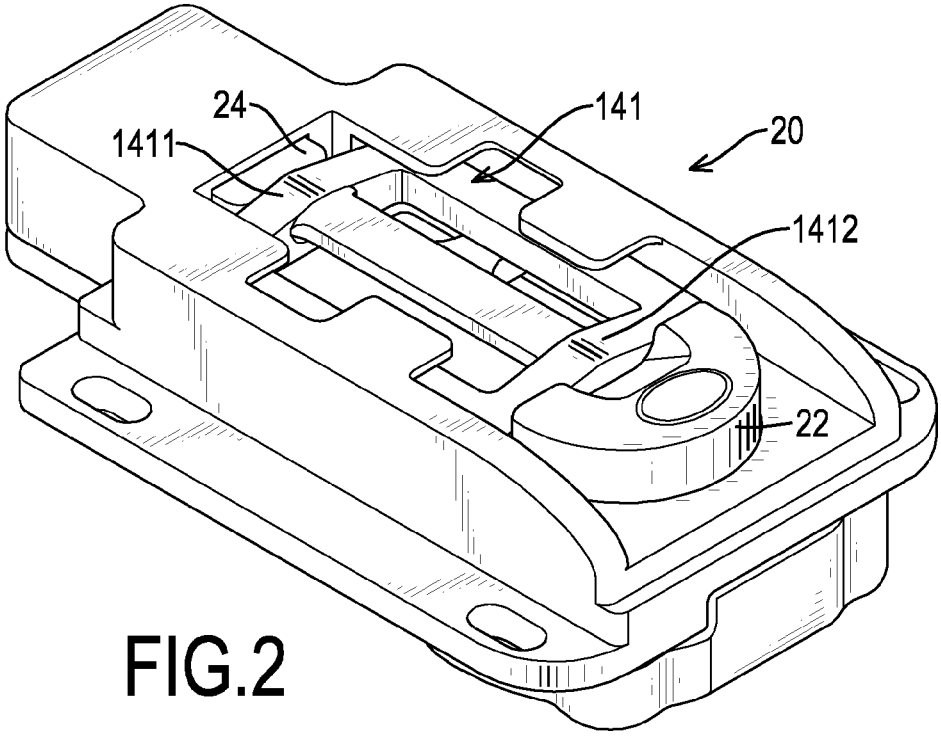
FIG. 2 is an enlarged perspective view of the fastener device of the high chair in FIG. 1.
Figure 3:
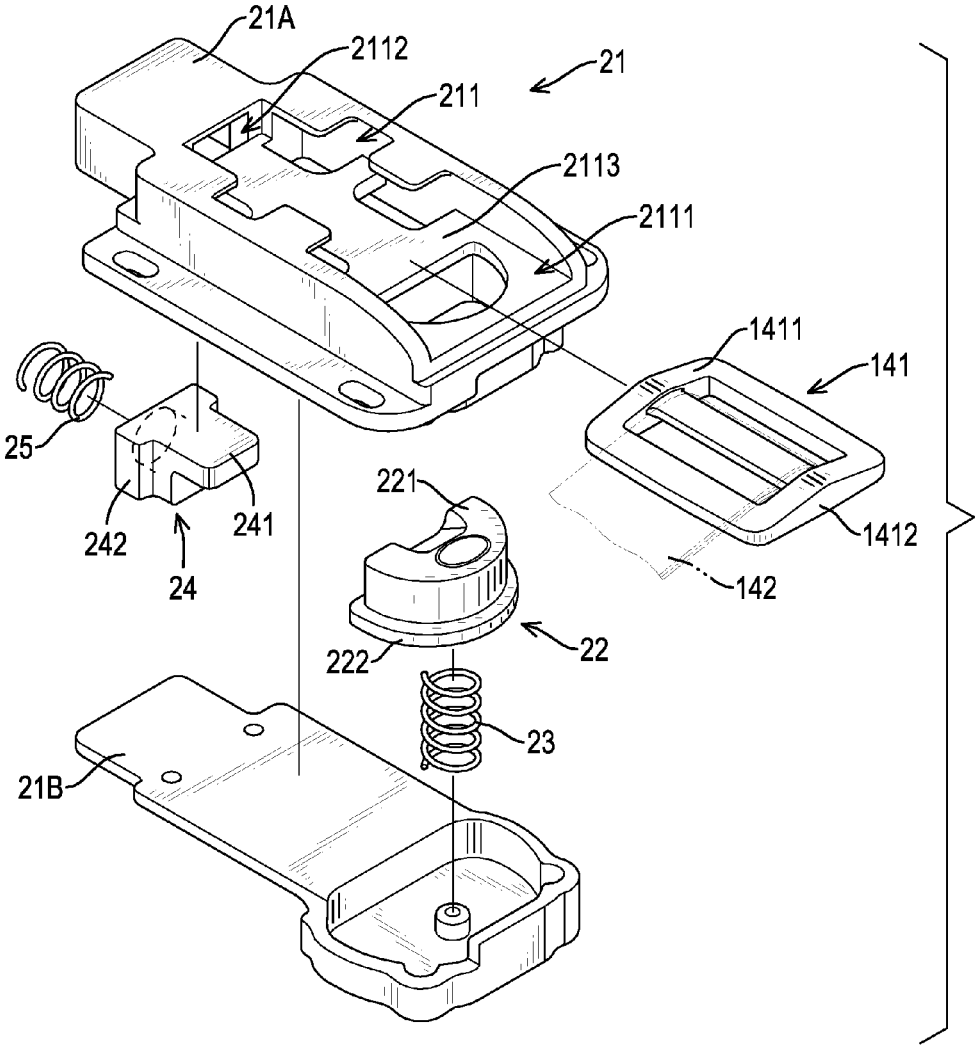
FIG. 3 is an enlarged exploded perspective view of the fastener device of the high chair in FIG. 2.
Figure 4:
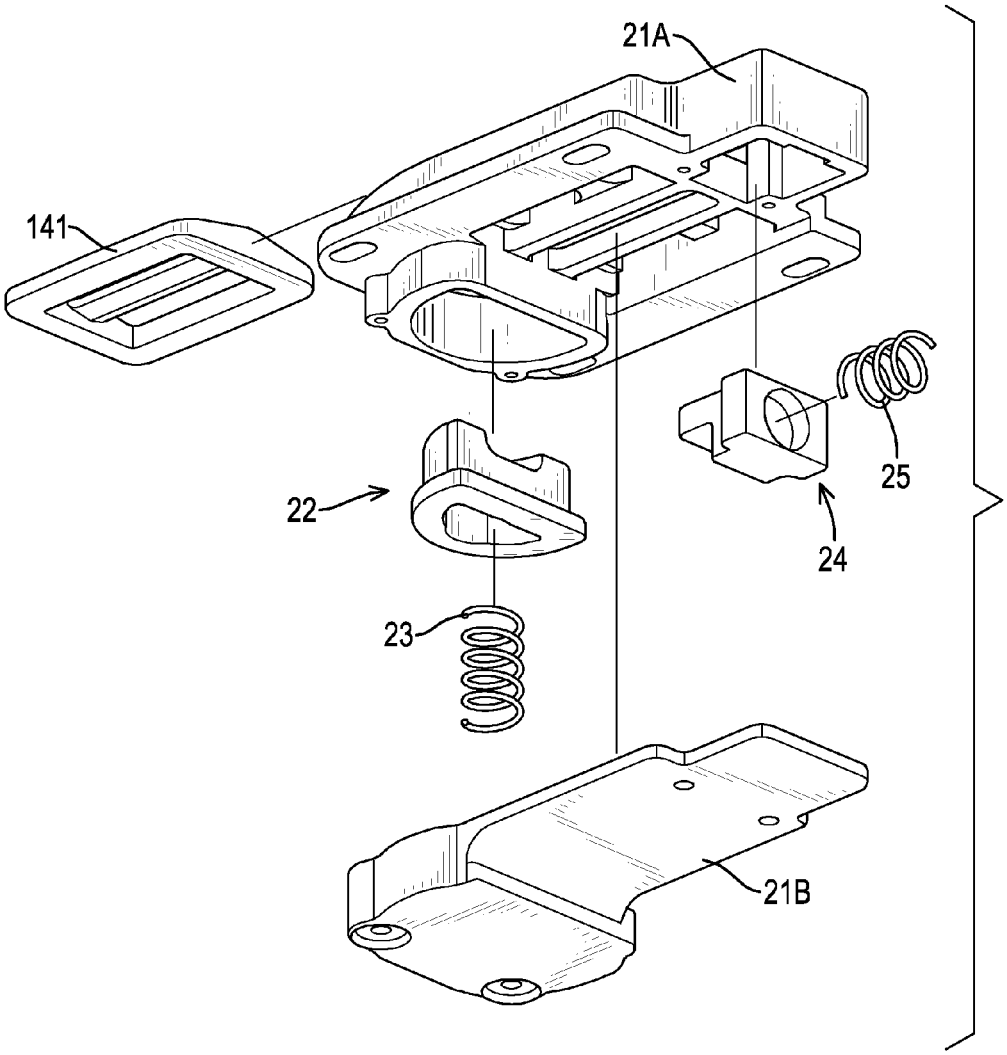
FIG. 4 is another enlarged exploded perspective view of the fastener device of the high chair in FIG. 2.

With reference to FIGS. 1 to 3, a high chair in accordance with the present invention comprises a chair device 10 and two fastener devices 20.

The chair device 10 has a base 11, a pillar 12, a main chair 13 and a belt unit 14. The pillar 12 is securely mounted on a top of the base 11. The base 11 and the pillar 12 are defined as a support.

The main chair 13 is securely mounted on a top end of the pillar 12 and has a bottom, a lying surface 131 and two mounting recesses. The mounting recesses are formed in the lying surface 131.

The belt unit 14 is mounted on the main chair 13 and has two belt buckles 141 and a belt 142. Each belt buckle 141 has a first end 1411 and a second end 1412 opposite to the first end 1411 of the belt buckle 141.

The belt 142 has two connecting ends and a chair end. The connecting ends of the belt 142 are respectively connected with the belt buckles 141. The chair end of the belt 142 is securely connected with the main chair 13. The chair device 10 may be conventional and detailed description is omitted.

With reference to FIGS. 2, 3, 4 and 6, the fastener devices 20 are respectively and securely connected with the mounting recesses of the chair device 10. Each fastener device 20 has a main body 21, a button 22, a button elastic member 23, a chunk 24 and a chunk elastic member 25.

Take one fastener device 20 and one mounting recess for example.

The main body 21 has a first housing 21A and a second housing 21B securely connected with the first housing 21A.

The main body 21 is securely mounted in the mounting recess and has an outer surface and a buckle recess 211. The buckle recess 211 is formed in the outer surface of the main body 21, receives the belt buckle 141 and has an open side 2111, a closed side 2112, a recess opening and a recess bottom 2113. The closed side 2112 of the buckle recess 211 is opposite to the open side 2111 of the buckle recess 211. The recess opening of the buckle recess 211 faces a front of the main chair 13 and has a width. The width of the recess opening of the buckle recess 211 is smaller than that of the belt buckle 141 to prevent the belt buckle 141 from escaping. The recess bottom 2113 is opposite to the recess opening of the buckle recess 21.

The button 22 is located at the open side 2111 of the buckle recess 211, is capable of moving relative to the recess bottom 2113 of the buckle recess 211 and has a pushed section 221 and a pressed section 222. The pushed section 221 is slidably mounted through the recess bottom 2113 of the buckle recess 211 and has a side surface abutted by the second end 1412 of the belt buckle 141. The pressed section 222 is connected integrally with the pushed section 221 and is located in the main body 21.

The button elastic member 23 is mounted in the main body 21 and presses against the pressed section 222 to recover a position of the button 22.

The chunk 24 is slidably mounted on the main body 21 and has a lump section 241 and an abutted section 242. The lump section 241 is slidably mounted through the closed side 2112 of the buckle recess 211 and abuts the first end 1411 of the belt buckle 141. The abutted section 242 is connected integrally with the lump section 241 and is located in the main body 21.

The chunk elastic member 25 is mounted in the main body 21 and presses against the abutted section 242 to recover a position of the chunk 24.

Preferably, the button elastic member 23 and the chunk elastic member 25 may be springs, resilient and bent metal strips, or plastic elastomers. The present invention does not limit the formats of the chunk elastic member 25 and the button elastic member 23. The present invention does not limit numbers of the mounting recesses and the fastener devices 20.

Figure 5:
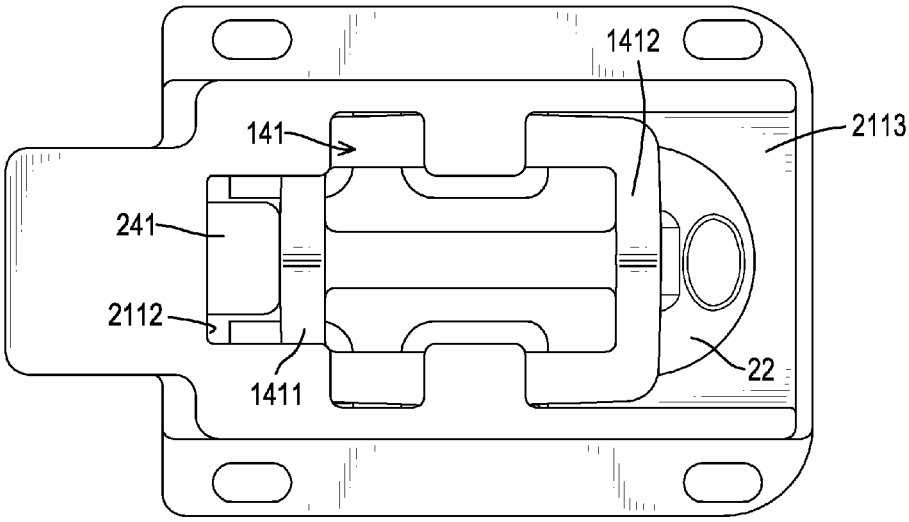
FIG. 5 is an enlarged top view of the fastener device of the high chair in FIG. 2, wherein the chunk protrudes and the belt buckle slides toward the open side of the buckle recess.
Figure 6:
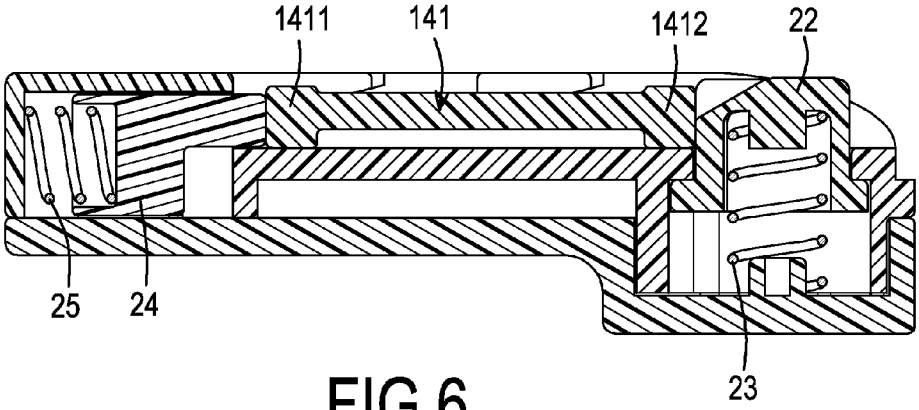
FIG. 6 is an enlarged cross sectional side view of the fastener device of the high chair in FIG. 2.
Figure 7:
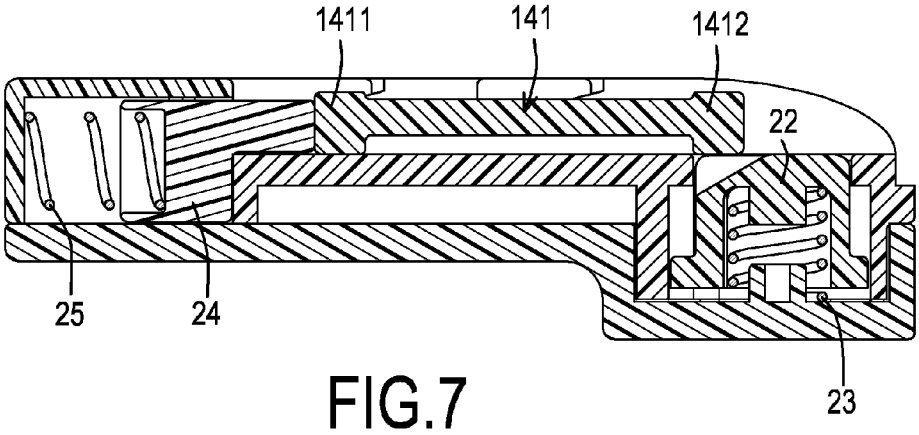
FIG. 7 is an enlarged operational cross sectional side view of the fastener device of the high chair in FIG. 5.
Figure 8:
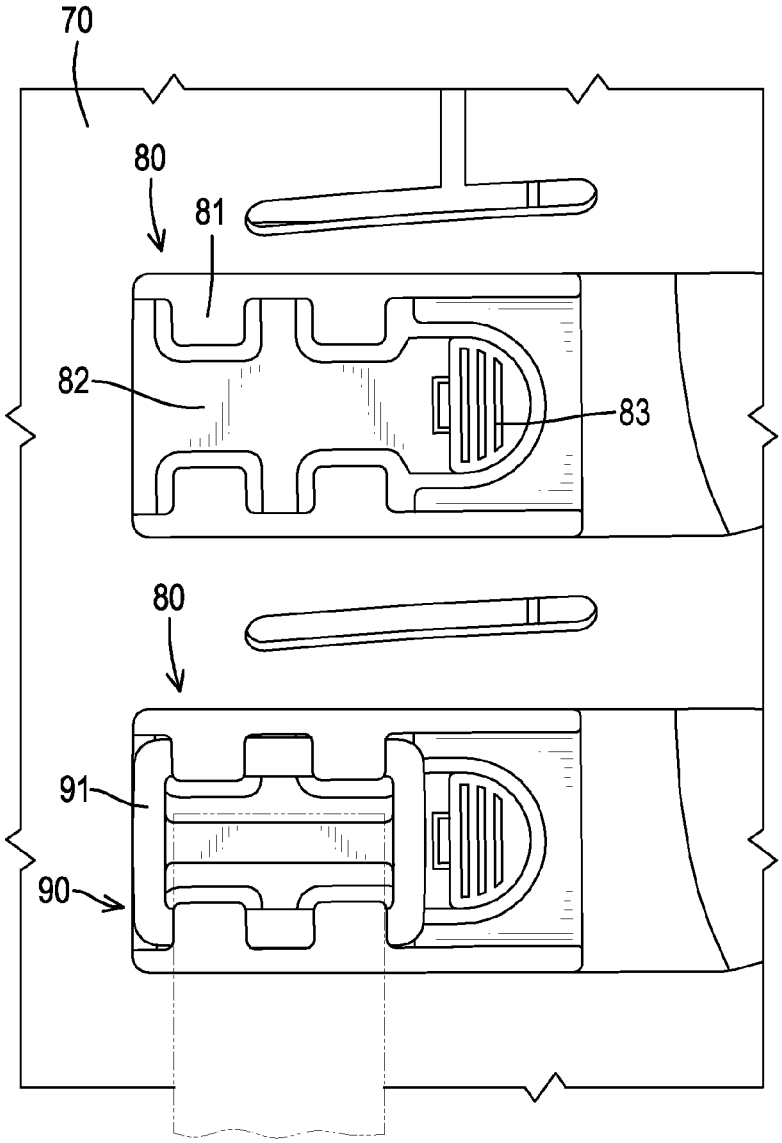
FIG.8 PRIOR ART
FIG. 8 is a partial top view of a fastener device of a conventional high chair in accordance with the prior art.
Figure 9:
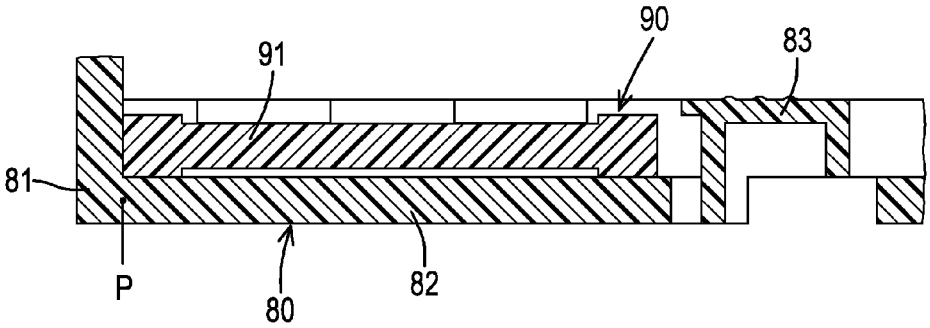
FIG.9 PRIOR ART
FIG. 9 is an enlarged cross sectional side view of the fastener device of the conventional high chair in FIG. 8, wherein the fastener device is connected with a belt buckle.

With reference to FIGS. 5 and 7, the belt buckle 141 is about to be taken out from the buckle recess 211. The button 22 is pushed downwardly and is retracted to allow the belt buckle 141 to slide latitudinally. At the same time, the chunk 24 protrudes into the buckle recess 211 to push the belt buckle 141. Consequently, the belt buckle 141 slides to a position above the button 22 and prevents the button 22 from protruding. Accordingly, the belt buckle 141 is easily taken out.

With reference to FIGS. 5 and 7, the belt buckle 141 is about to be inserted into the buckle recess 211. The button 22 is pushed downwardly and is retracted to allow the belt buckle 141 to slide into the buckle recess 211. After the belt buckle 141 pushes the chunk 24 to make the chunk 24 retract into the main body 21, the button 22 is then pushed by the button elastic member 23, recovers to an original position and limits the belt buckle 141.

From the above description, it is noted that the present invention has the following advantages:

1. Easy taking out and inserting:

To push and pull the button 22 is easy, so the belt buckle 141 is easily taken out and inserted. Accordingly, a user can operate the present invention conveniently.

2. Automatic pushing:

The chunk 24 automatically pushes the belt buckle 141 to make the belt buckle 141 slide. Consequently, the belt buckle 141 can automatically prevent the button 22 from protruding and this is greatly convenient for a user to take out the belt buckle 141.

3. Compact structure:

The structure of the fastener device 30 of the high chair in accordance with the present invention is compact, can be assembled easily and is operated conveniently.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high chair comprising:

a chair device having
- a main chair having
  - a bottom;
  - a lying surface; and
  - a mounting recess formed in the lying surface;
- a support mounted securely on the bottom of the main chair; and
- a belt unit mounted on the main chair and having
  - a belt buckle having
    - a first end; and
    - a second end opposite to the first end of the belt buckle; and
  - a belt connected with the belt buckle; and a fastener device securely connected with the chair device and having
- a main body securely mounted in the mounting recess and having
  - an outer surface;
  - a buckle recess formed in the outer surface of the main body, receiving the belt buckle and having
    - an open side;
    - a closed side opposite to the open side of the buckle recess;
    - a recess opening facing a front of the main chair and having a width, wherein the width of the recess opening of the buckle recess is smaller than that of the belt buckle to prevent the belt buckle from escaping;
    - a recess bottom opposite to the recess opening of the buckle recess;
- a button located at the open side of the buckle recess, capable of moving relative to the recess bottom of the buckle recess and having
  - a pushed section slidably mounted through the recess bottom of the buckle recess and having a side surface abutted by the second end of the belt buckle; and
  - a pressed section mounted securely to the pushed section and located in the main body;
- a button elastic member mounted in the main body and pressing against the pressed section to recover a position of the button;
- a chunk slidably mounted on the main body and having
  - a lump section slidably mounted through the closed side of the buckle recess and abutting the first end of the belt buckle; and
  - an abutted section securely mounted on the lump section and located in the main body; and
- a chunk elastic member mounted in the main body and pressing against the abutted section to recover a position of the chunk.

2. The high chair as claimed in claim 1, wherein the button elastic member and the chunk elastic member are springs.

* * * * *